United States Patent [19]

Howard, Jr. et al.

[11] Patent Number: 5,063,637

[45] Date of Patent: Nov. 12, 1991

[54] LAMINATED ARTICLE WITH HINGE AND METHOD FOR MANUFACTURING LAMINATED ARTICLES

[76] Inventors: Daggett H. Howard, Jr.; Donald F. Wood, both of San Francisco, Calif.

[21] Appl. No.: 599,276

[22] Filed: Oct. 16, 1990

Related U.S. Application Data

[63] Continuation of Ser. No. 325,556, Mar. 17, 1989, abandoned.

[51] Int. Cl.[5] ..... B42D 3/00

[52] U.S. Cl. ..... 16/225; 281/29; 281/35

[58] Field of Search ..... 16/225, DIG. 13; 281/29, 35, 18, 20, 48

[56] References Cited

U.S. PATENT DOCUMENTS

| | | | |
|---|---|---|---|
| 2,294,276 | 8/1942 | Catlinicos | 283/34 |
| 2,390,125 | 12/1945 | Schade | 281/29 |
| 2,486,330 | 10/1949 | Schade | 281/29 |
| 2,505,743 | 4/1950 | Rose | 281/29 |
| 2,846,782 | 8/1958 | Hofshagen | 434/150 |
| 2,889,638 | 6/1959 | Anderson | 281/15.1 |
| 3,167,207 | 1/1965 | Kruger et al. | 220/334 |
| 3,168,424 | 2/1965 | Sender | 281/35 |
| 3,206,225 | 9/1965 | Oleson | 281/35 |
| 3,257,128 | 6/1966 | Schneider | 281/29 |
| 3,433,279 | 3/1969 | Seamon | 150/145 |
| 3,615,035 | 10/1971 | Newton | 220/334 |
| 4,360,346 | 11/1982 | Ehsanipour | 281/31 |
| 4,636,065 | 1/1987 | Kanemitsu et al. | 355/758 |
| 4,673,197 | 6/1987 | Shtipelman et al. | 283/54 |
| 4,744,689 | 5/1988 | Sternberg | 281/29 |

FOREIGN PATENT DOCUMENTS

| | | | |
|---|---|---|---|
| 0008326 | 1/1977 | Japan | 281/35 |

*Primary Examiner*—Kurt Rowan
*Assistant Examiner*—James Miner
*Attorney, Agent, or Firm*—Limbach, Limbach & Sutton

[57] ABSTRACT

A laminated article of two or more leaves with an improved hinge and method for manufacturing laminated articles. This improved hinge pivots easily and does not act to change the position of the leaves it connects. The hinge means opens from 0° to 360° and yet allows rigid, substantial leaves.

11 Claims, 2 Drawing Sheets

LAMINATED ARTICLE WITH HINGE AND METHOD FOR MANUFACTURING LAMINATED ARTICLES

This is a continuation of co-pending application Ser. No. 07/325,556 filed on Mar. 17, 1989, now abandoned.

BACKGROUND OF THE INVENTION

1. Field of Invention

This inventions relates to an improved laminated article with an improved integral flexible hinge and methods for manufacturing laminated articles.

2. Description of Prior Art

There are a variety of flexible hinges known in the prior art. For example, in U.S. Pat. No. 4,636,065 a flexible hinge is disclosed that attempts to solve the stress and durability problems associated with the folding of a copier cover plate. The design solution involves setting back one end of the edges of the cover plate at an angle to avoid shearing forces. Another example of a flexible hinge is disclosed in U.S. Pat. No. 3,615,035 for the lid of a pharmaceutical box. The unique assembly problems associated with a box lid are solved by a tongue and groove design. Another example of a flexible hinge is disclosed in U.S. Pat. No. 3,167,207 for a plastic container. The need for a firm container body yet a flexible hinge is solved by having integral hinge anchor lugs on the container adapted to engage a separate flexible hinge assembly.

While is clear that the design in each of the above cases represents an attempt to solve the unique problems associated with the folding of the leaves of the particular article requiring a hinge, there is also a problem common to all of the cases. This problem is the incompatibility of a flexible hinge with sturdy leaves. That is to say, if the article is to be cast as a single piece from sturdy material, the hinge will have the sturdy characteristics of the leaves and will not be flexible. On the other hand, if the article is to be cast as a single piece from flexible material, the hinge will be flexible while the leaves will not be sturdy. This problem is significant when considering large scale manufacture where a monolithic design could result in significant cost savings.

The present invention involves the joining of two or more laminated leaves of an article together. The problem of joining laminated leaves together inexpensively such that they might fold against each other easily and tightly has been approached in the past in two predominant ways.

The most common solution is that employed in restaurant menu construction. The leaves in this case are pages, printed side by side on a single sheet of paper. This sheet of paper is then laminated by conventional means with relatively thin laminating film (usually a polypropylene/mylar film of approximately 0.008 centimeters or less), and subsequently folded in half to create a crude hinge apparatus. Sometimes the paper is scored during the printing process prior to lamination to facilitate folding.

The advantage of this process is that it is easy to accomplish. There are many disadvantages, however, to this method. First and foremost, because the web of the hinge apparatus is the exact same material and thickness as the leaves, the hinge apparatus of this type exhibits a significant bending resistance. Because of bending resistance, hinges of this type of construction have the disadvantage that the leaves are very limited in their degree of pivot and ease of pivot. Furthermore, because of the extent of bending resistance relative to the weight of the leaves, the web of the hinge apparatus exhibits memory. Memory is defined as the tendency of the web via bending resistance to cause the leaves to retreat to a prior position after manipulation to a new position. Memory is most commonly observed when a menu is opened flat on a table top; the menu resists the 180° angle and the pages retreat toward the closed position.

There are other disadvantages that stem from the bending resistance of the web. For example, because the hinge means cannot effectively open up to 360°, the order of the pages cannot be reversed, precluding the ability to study any side of either page with the article in its most compact configuration. Similarly, because of bending resistance there is difficulty in handling, low durability, and a sense of overall inferior quality for the user. All of these problems are, of course, compounded with multi-page articles.

A rarely utilized solution to the overall problem involves the use of book tape, an adhesive backed, 1"-2" wide, polypropylene tape. The two pages are printed on separate sheets of paper and then individually laminated. The two sheets are aligned by hand, edge to edge with a small gap, and then taped by hand with the book tape (preferably on both the front and back sides of the joint).

The advantage of this method is that it overcomes some of the disadvantages mentioned above. There are, however, disadvantages with this method as well. First, because of the hand labor involved in assembly, the article is not easily produced (especially in quantity) and is therefore expensive to make. Second, because the tape is not invisible, there is a distinct line at its edges that partially clouds the image underneath it. Third, the tape's adhesive is not as permanent as the laminated pages. Fourth, the tape's adhesive is subject to oozing at warm temperatures. Finally, the tape's adhesive collects dirt at the edge of the tape.

The present invention avoids these disadvantages. The present invention provides a laminated article of two or more leaves with an improved hinge and methods for manufacturing the same. When the leaves are to display printed matter, the present invention provides hingedly joined leaves in a suitable format for such articles as maps, menus, references, and guides.

This improved hinge pivots easily. Moreover, the bending resistance of the web does not act to change the position of the leaves it connects. The hinge opens from 0 to 360° and yet allows rigid, substantial leaves. The hinge is integral and invisible in its attachment, and yet is as durable as the leaves it connects. The invention thereby solves the incompatibility problem associated with monolithic designs. Furthermore, the improved hinge neither gathers dirt nor obscures any image that might be printed on the leaves in any way. Importantly, this improved hinge is simple, inexpensive, and readily assembled in quantity.

Readers will find further objects and advantages of the invention from a consideration of the ensuing description and the accompanying drawings.

SUMMARY OF THE INVENTION

The present invention is an improved hingedly joined laminated article of the type wherein two or more leaves having a thickness are spaced apart so as to form one or more gaps having a width, and wherein a bottom sheet of laminating film having a thickness contacts one side of the two or more leaves, and wherein a top sheet of laminating film having a thickness contacts the other side of the two or more leaves and contacts the bottom sheet of laminating film at one or more gaps to form one or more webs having a bending resistance, the combination with the one or more webs of a means for preventing said bending resistance from acting to substantially change the position of said leaves. The preventing means, in particular embodiments, comprises means for providing sufficient leave weight such that said leaves exert enough moment force via gravity to overcome said bending resistance of said webs.

In one embodiment, the present invention is an improved hingedly joined laminated article of the type wherein two or more leaves having a thickness are spaced apart so as to form one or more gaps having a width, and wherein a bottom sheet of laminating film having a thickness contacts one side of the two or more leaves, and wherein a top sheet of laminating film having a thickness contacts the other side of the two or more leaves and contacts the bottom sheet of laminating film at one or more gaps to form one or more webs having a bending resistance, the improvement comprising means for preventing the bending resistance from acting to substantially change the position of the leaves and means for aligning the leaves. In one particular embodiment the aligning means comprises one or more integrally connected tabs bridging the gaps between the leaves.

For the manufacture of one embodiment, the method of the present invention comprises the steps of a) loading two or more leaves into a feed tray having multiple compartments and b) laminating the two or more leaves. The feed tray is used for introducing leaves into a laminating machine and comprises a means for supporting a plurality of leaves and a means for aligning the leaves.

For the manufacture of another embodiment, the method of the present invention comprises the steps of a) die cutting a single leave to yield two or more leaves separated by one or more gaps bridged by one or more tabs and b) laminating the two or more leaves.

DESCRIPTION OF THE INVENTION

The present invention concerns an improved laminated article of two or more leaves with an improved hinge and methods for manufacturing laminated articles. The article might be anything utilizing a hinge to join one or more of its components (menu, book, container etc.). The leaves may be made of a number of different materials (such as paper, cardboard, wood, plastic, Masonite, aluminum, and steel). Where it is desired that printed matter be displayed, the leaves may contain printed matter or the laminating material may have printed matter.

The present invention contemplates an improvement over the article of the type having two or more leaves having a thickness, which are spaced apart so as to form one or more gaps having a width, wherein a bottom sheet of laminating film having a thickness contacts one side of the two or more leaves, and wherein a top sheet of laminating film having a thickness contacts the other side of the two or more leaves and contacts the bottom sheet of laminating film at one or more gaps to form one or more webs having a bending resistance. The present invention contemplates a means for preventing the bending resistance from acting to substantially change the position of the leaves. In one embodiment, the preventing means comprises means for providing sufficient leave weight such that the leaves exert enough moment force via gravity to overcome the bending resistance of the one or more webs.

EXAMPLE 1

Figure 1:
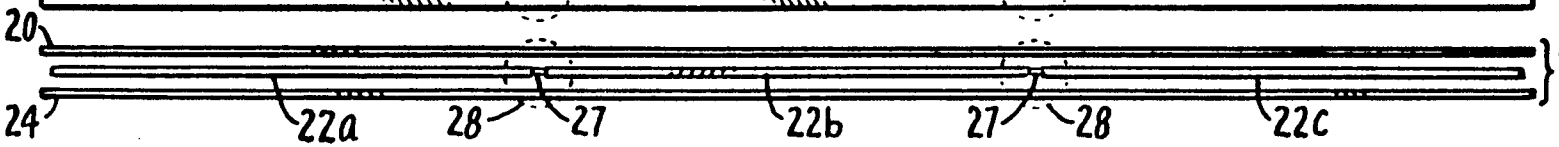
FIG. 1 is a side view of one embodiment of the invention.

FIG. 1 shows one embodiment of a hingedly joined laminated article of the present invention. From FIG. 1 it is clear that this embodiment of a hingedly joined laminated article comprises a bottom sheet of laminating film (24) (usually a polypropylene/mylar film or similar material) which is bonded in a lamination process to the underside of the three leaves (22*a*, 22*b*, 22*c*) and to a top sheet of laminating film (20) at the gaps (27) to form webs (28). Similarly, the top sheet of laminating film (20) is bonded in a lamination process to the top side of the three leaves (22*a*, 22*b*, 22*c*) and to the bottom sheet of laminating film (24) at the webs (28).

In this embodiment of the invention, the preferred thickness of the top (20) and bottom (24) sheets of laminating film is approximately 0.008 centimeters. The leaves (22*a*, 22*b*, 22*c*) are between approximately 0.04 and 0.12 centimeters in thickness, between approximately 21 and 23 centimeters in width, and between approximately 27 and 29 centimeters in length. The gaps (27) between the leaves (22*a*, 22*b* and 22*b*, 22*c*) are slightly (approximately 0.08 centimeters) greater than the combined thickness of twice the thickness of one leave and four times the thickness of a sheet of laminating film.

To facilitate folding, it is desirable to adjust the size (length and width) of the leaves in accordance with their relative position. For example, in a three leave article, it is desirable to have outer leaves that are slightly smaller than the middle leaves. In this manner all folding configurations can be more easily achieved.

Of course, the invention may comprise more than three leaves joined together in this manner. For example, a series of four or more leaves connected in a fanfold, two directional fold, or other folding arrangement is possible. Similarly, the invention may comprise only two leaves joined together in this manner.

An article according to the invention may have a wide variety of dimensions, film thicknesses, leave compositions, leave thicknesses, and gap sizes other than those shown in Example 1. Nonetheless, the invention preferably employs a relationship between these variable such that, in an open or closed horizontal position, the weight of the leaves (22*a*, 22*b*, 22*c*) exerts enough moment force (via gravity) to overcome the bending resistance of the webs (28), which in turn is determined by the thickness of the film (20, 24), the size of the gap (27) (i.e., the width of the web), and the subsequent radius of the web (28) (when in a closed position). By controlling the relationship of the above dimensions in this way, the invention will be such that the leaves of the articles will lie relatively flat in either an open or closed position.

During the actual assembly of the above mentioned component materials it is imperative to keep the leaves (22a, 22b, 22c) aligned, with each other and with the axial direction of the laminating machine, to insure proper hinge operation of the webs (28) and a high tolerance product.

One method of this invention involves the use of a specially constructed feed tray for introducing leaves into a laminating machine. This method comprises the steps of a) loading two or more leaves into a feed tray having multiple compartments and b) laminating said two or more leaves. In some cases, the method further comprises, prior to step b), moving the feed tray such that the two or more leaves contact the rollers of a laminating machine. Preferably, the laminating of step b) comprises bonding i) a bottom sheet of laminating film to one side of two or more leaves ii) a top sheet of laminating film to the other side of two or more leaves and iii) the bottom sheet of laminating film at one or more gaps to the top sheet of laminating film to form one or more webs.

EXAMPLE 2

Figure 3:
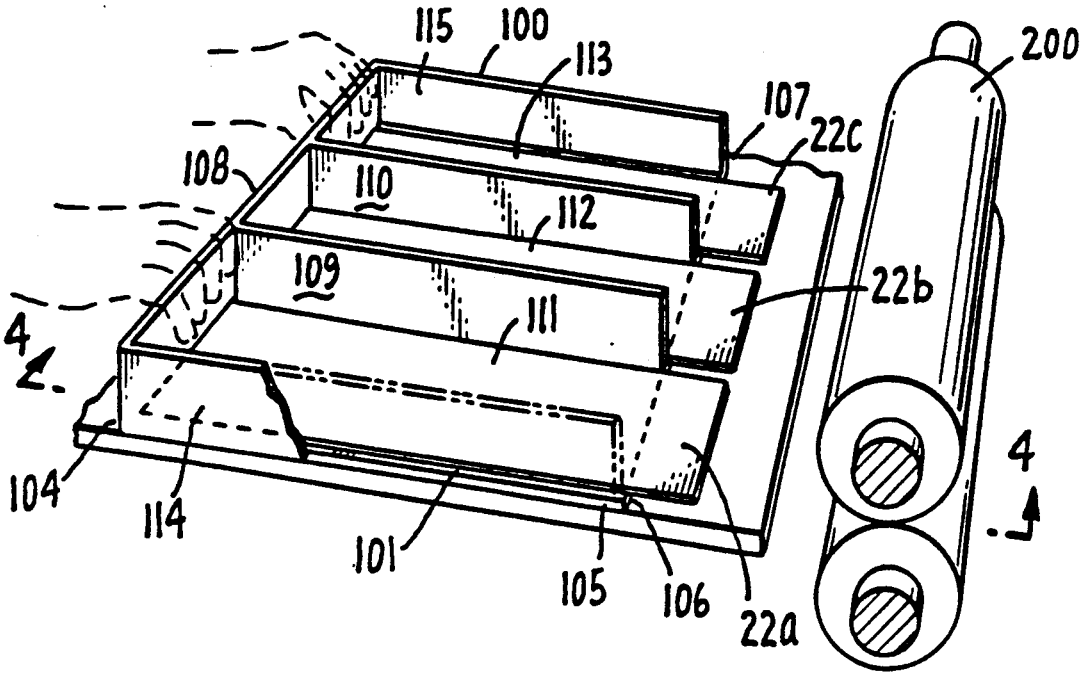
FIG. 3 is a perspective view of the feed tray used in the manufacturing of one embodiment of the article of the present invention.
Figure 4:
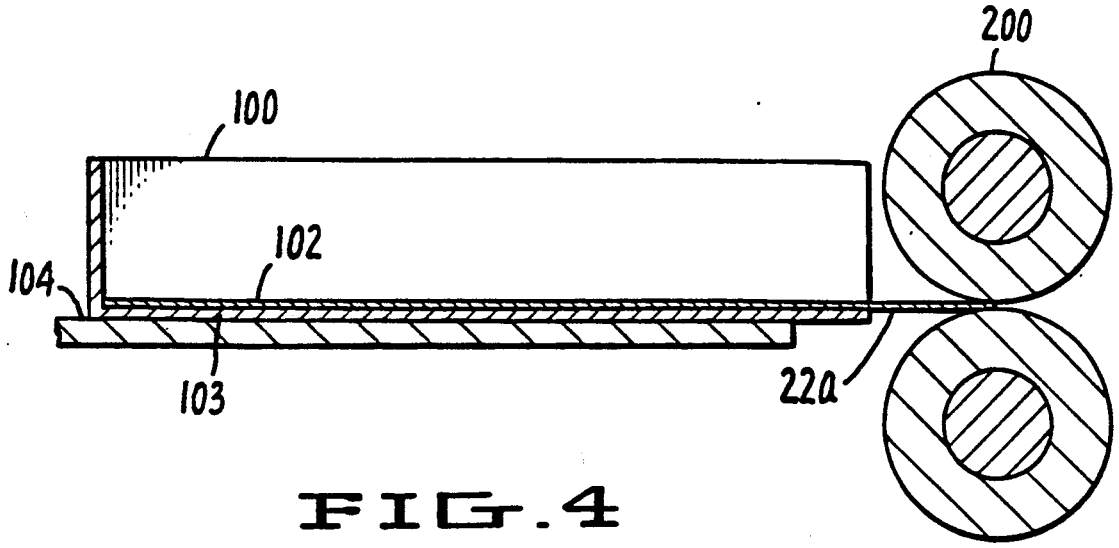
FIG. 4 is a side view of the feed tray of FIG. 3 shown in contact with the laminating machine.

FIGS. 3 and 4 show one embodiment of a feed tray (100) having a means for supporting a plurality of leaves and a means for aligning the leaves during the manufacture of one embodiment of the present invention (Example 1). The supporting means comprises a flat bottom (101) having two sides (102 and 103) and four edges (104–107). The aligning means comprises an end guard (108) perpendicularly attached near one edge (in this case, edge 104) of the flat bottom (101) and separation guards (109 and 110) perpendicularly attached to flat bottom (101) and positioned in substantially a perpendicular relationship to end guard (108) to define compartments (111–113). The compartments (111–113) are separated from each other by approximately the width of the desired gaps (27) (FIG. 1).

In this embodiment, the feed tray (100) has two side guards (114 and 115) perpendicularly attached to the flat bottom (101) near opposite edges (105 and 107) and positioned in substantially a perpendicular relationship to end guard (108) and in a substantially parallel relationship to separation guards (109 and 110). In other embodiments, however, it is contemplated that the feed tray (100) may have fewer side guards and even no side guards. For illustration purposes, leaves (22a, 22b, 22c) are shown in position for laminating.

The design of the feed tray will vary depending on the number of leaves to be laminated. Where it is desired to manufacture a three leave article, the feed tray has three compartments, the width substantially equal to the width of the individual leaves and the length less than the length of the individual leaves (preferably two thirds of the length).

When manufacturing in production quantities, a loading tray (not shown) is secured to a loading table (not shown), such that the loading tray is approximately 2.5 to 4.0 centimeters higher than the main surface of the table. In front of the loading tray is a space large enough to accommodate the feed tray and a guide which is aligned with one side of the loading tray.

In use, the loading tray is stocked with approximately 100 leaves. The feed tray (100) is then placed in front of the loading tray, aligned with the guide, and loaded by an operator who manually "drags" each leave from the loading tray into the compartments (111–113) of the feed tray (100) with the help of a rubber fingertip. The operator then moves the feed tray to the laminating machine (not shown), aligns the edges (105–107) of the flat bottom (101) of the feed tray (100) with the machine's edge guide (not shown), and pushes the feed tray (100) toward the lamination rollers (200) until the leaves (22a, 22b, 22c) simultaneously engage them (FIG. 4). The process is then repeated. Additional speed can be obtained through the use of another feed tray and operator, whereby one man loads the feed tray and the other feeds the laminating machine.

EXAMPLE 3

Figure 2:
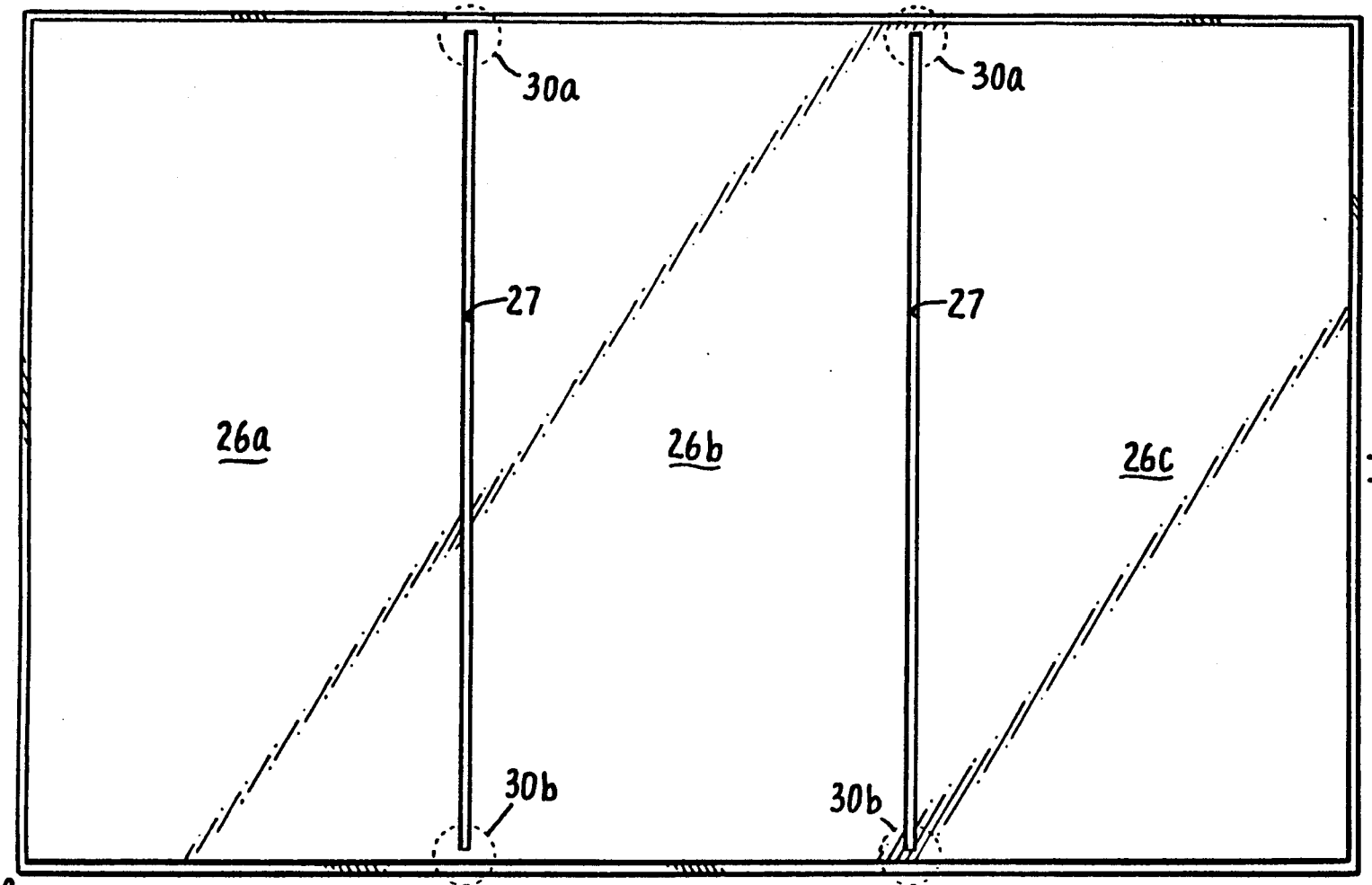
FIG. 2 is a top view of a second embodiment of the invention.

FIG. 2 shows a second embodiment of the article of the present invention. This embodiment is an improved hingedly joined laminated article of the type wherein two or more leaves having a thickness are spaced apart so as to form one or more gaps having a width, wherein a bottom sheet of laminating film having a thickness contacts one side of two or more leaves, and wherein a top sheet of laminating film having a thickness contacts the other side of two or more leaves and contacts the bottom sheet of laminating film at one or more gaps to form one or more webs having a bending resistance; the improvement comprises means for preventing said bending resistance from acting to substantially change the position of the leaves and means for aligning the leaves during manufacture.

Preferably, the aligning means comprises one or more integrally connected tabs bridging said gaps between said leaves. For example, FIG. 2 shows relatively thin (between approximately 0.08 and 0.16 centimeters) tabs (30a, 30b) bridging the gap between three leaves (26a, 26b, 26c). Of course, the tabs (30a, 30b) could be more numerous, of various dimensions and positioned in many different ways other than that shown in FIG. 2. It should be noted that the bigger the tabs, the better durability in manufacture. On the other hand, bigger tabs typically have higher bending resistance.

The tab arrangement in this embodiment is accomplished by a method of manufacture comprising the steps of a) die cutting a single leave to yield two or more leaves separated by one or more gaps bridged by one or more tabs and b) laminating the two or more leaves. Preferably, the laminating comprises bonding i) a bottom sheet of laminating film to one side of the two or more leaves ii) a top sheet of laminating film to the other side of the two or more leaves and iii) the bottom sheet of laminating film at one or more gaps to the top sheet to form one or more webs having a given bending resistance. Preferably, the weight of said leaves exert enough moment force via gravity to overcome the bending resistance of said webs, when the article is in a substantially horizontal position.

With the second embodiment, the number of leaves in the laminated article is not limited by the width of the laminating machine as in the first method, because the gaps in the die cut sheet may be positioned perpendicular to the axial direction of the machine, allowing an almost infinite string of leaves per article. Rate of production is enhanced while waste is held to a minimum. This embodiment greatly facilitates mass production of the article by registering the leaves during the lamination process, while having little negative effect on the bending characteristics of the webs (28). This embodiment of the article may also comprise a series of three or more leaves connected in a fanfold, two directional fold, or other folding arrangement. Of course, the article may also comprise only two leaves.

While a number of manufacturing sequences are possible for the second embodiment, the proper manufacturing sequence must take into consideration the impact of each step on later steps.

EXAMPLE 4

We have found that the preferred manufacturing sequence for making a laminated map with an improved integral flexible hinge is as follows:

Step 1. Cartography is selected and configured, along with border and logos, to conform to an 11" by 17" layout.

Step 2. This artwork is expanded in the 17" dimension such that at the hinges the artwork repeats itself for a short distance either side of the center line of the hinge.

Step 3. Screens are shot of the artwork.

Step 4. The artwork is printed (using a sheet press) four up (i.e. four repeating patterns) and registered on both sides of 23" by 35" heavy point paper sheets (16 point C2S Stellar - Gloss Cover Stock). Printed sheets must be allowed to dry completely to avoid "offset marring" during ream cutting. The long grain of the paper should be aligned perpendicular to the slots to be die cut.

Step 5. Sheets are ream cut into smaller sheets 11" by 17 11/64". This is necessary to preserve the integrity of the tabs; if one attempts to ream cut after the die cutting, the ream cutting damages and even rips the tabs.

Step 6. Smaller sheets are die cut according to FIG. 2 such that a slot is cut at each hinge leaving a small connecting tab at the top and bottom of each hinge. Die cutting is accomplished on an old Heidelburg Press using a steel rule die plugged with silicon to help eject the strip. Hand stripping completes the die cutting process.

Step 7. Die cut sheets are fed into a laminating machine, such as a Ledco (Hemock, N.Y.) Industrial 25 laminating machine, loaded with 18" Rexham Laminex (Charlotte, N.C.) Permalam 3 mil laminating film, set at approximately 265° F. and a relatively light pressure), either by hand or with the aid of an automatic sheet feeder, such that the gaps are aligned with the axial direction of the machine. (The gaps could be aligned perpendicular to the axial direction of the machine, but bonding at the webs is then inferior.)

Step 8. During lamination the side edges are trimmed.

Step 9. After passing through the laminating machine, the laminated die cut sheets proceed through an automatic cut off machine which trims the top and bottom edges and drops the completed product into a receiving container. (We use an Accumatic II 25" guillotine cutter, D & K, Elk Grove, Ill.)

Step 10. (Optional) The final product normally will have sealed edges (i.e. the laminating film extends beyond the leaves). As an option, the side edges can be cut flush with the end of the leaves during lamination. Of course, the side edges can be cut even deeper such that even the tabs are cut away, to yield finished article without tabs.

From the above description it is clear that the present invention avoids the disadvantages of other designs. This improved hinge pivots easily and does not act to change the position of the leaves it connects. The hinge opens from 0° to 360° and yet allows rigid, substantial leaves. Furthermore, the improved hinge neither gathers dirt nor obscures any image that might be printed on the leaves or on the laminated film.

The invention solves the incompatibility problem associated with monolithic designs. By formulating the hinge from the flexible, laminating material, the hinge is 1) flexible, 2) integral and 3) invisible in its attachment. On the other hand, the article is made sturdy by the sturdy leave material under the flexible, laminated material. Because the invention allows for laminating in one piece, articles made according to the present invention are readily and inexpensively assembled in quantity.

While the above description contains many specificities, the reader should not construe these as limitations on the scope of the invention, but merely as exemplifications of preferred embodiments thereof. Those skilled in the art will envision many other possible variations that are within its scope.

For example, skilled artisans will be able to make the leaves to be hinged of many different materials such as cloth, wood, metal, and plastic. The film could also be made of other plastic materials, and, as noted above, the edges of an article according to the invention could be sealed or flush cut in many different configurations.

The hinge arrangement could be used in the construction of articles other than those described above. For instance, a container could be built using this hinge arrangement whereby an article is laminated, and subsequently folded such that one leave becomes a lid and another leave becomes a tray part.

Accordingly, the reader is requested to determine the scope of the invention by the appended claims and their legal equivalents, and not by the examples which have not been give.

What is claimed is:

1. A hingedly joined laminated article, comprising:

a) two or more leaves, each having a thickness, spaced apart so as to form one or more gaps having a width;

b) a bottom sheet of laminating film having a thickness and contracting one side of said two or more leaves;

c) a top sheet of laminating film having a thickness, contacting the other side of said two or more leaves and contacting said bottom sheet of laminating film at said one or more gaps to form one or more webs, wherein said gap width is equal to or greater than the combined thickness of twice the thickness of one leave and four times the thickness of said laminating film, and wherein said thickness of each leave is between approximately five and fifteen times said thickness of each sheet of said laminating film, so that said article is substantially flat when in a horizontal open or closed position.

2. The laminated article of claim 1, having two leaves, wherein said thickness of said laminating film is approximately 0.004 centimeters, and wherein said thickness of said leaves is between approximately 0.020 and 0.060 centimeters.

3. The laminated article of claim 1, having three leaves, wherein said thickness of said laminating film is approximately 0.008 centimeters, and wherein said thickness of said leaves is between approximately 0.040 and 0.120 centimeters.

4. The laminated article of claim 1, having four leaves, wherein said thickness of said laminating film is approximately 0.012 centimeters, and wherein said thickness of said leaves is between approximately 0.060 and 0.180 centimeters.

5. The laminated article of claim 1, having five leaves, wherein said thickness of said laminating film is approximately 0.008 centimeters, and wherein said thickness of said leaves is between approximately 0.040 and 0.120 centimeters.

6. The laminated article of claim 1, wherein said leaves are made of paper.

7. The laminated article of claim 1, wherein said laminating film contains printed matter.

8. The laminated article of claim 1, wherein said leaves contain printed matter.

9. The laminated article of claim 7 or 8, wherein said printed matter comprises a map.

10. The laminated article of claim 1, further comprising means for aligning said leaves.

11. The laminated article of claim 10, wherein said aligning means comprises one or more integrally connected tabs bridging said gaps between said leaves.

* * * * *